US007889146B2

(12) United States Patent
Halek et al.

(10) Patent No.: US 7,889,146 B2
(45) Date of Patent: Feb. 15, 2011

(54) MICROWAVE DEMULSIFICATION OF HYDROCARBON EMULSION

(75) Inventors: James Michael Halek, Southlake, TX (US); Philip Aaron Harris, North Richland Hills, TX (US); Richard Thompson, Houlton, WI (US); Robert Ferri, Cody, WY (US); Jonathan Squires, Keller, TX (US)

(73) Assignee: Enhanced Energy, Inc., Roanoke, TX (US)

( * ) Notice: Subject to any disclaimer, the term of this patent is extended or adjusted under 35 U.S.C. 154(b) by 0 days.

(21) Appl. No.: 12/344,801

(22) Filed: Dec. 29, 2008

(65) Prior Publication Data

US 2009/0146897 A1 Jun. 11, 2009

Related U.S. Application Data

(62) Division of application No. 10/619,011, filed on Jul. 14, 2003, now Pat. No. 7,486,248.

(51) Int. Cl.
*H01Q 13/10* (2006.01)

(52) U.S. Cl. ..... 343/771; 343/872

(58) Field of Classification Search ..... 343/719, 343/771, 872, 873, 770
See application file for complete search history.

(56) References Cited

U.S. PATENT DOCUMENTS

| | | | |
|---|---|---|---|
| 403,183 | A | 5/1889 | Firth |
| 1,672,198 | A | 6/1928 | Boving |
| 1,793,193 | A | 2/1931 | Price |
| 2,312,455 | A | 3/1943 | Trawick |
| 2,634,961 | A | 4/1953 | Ljungstrom |
| 2,757,738 | A | 8/1956 | Ritchey |
| 2,981,949 | A * | 4/1961 | Elliott ..... 343/771 |

(Continued)

FOREIGN PATENT DOCUMENTS

| | | |
|---|---|---|
| CA | 1199106 | 1/1986 |

(Continued)

OTHER PUBLICATIONS

U.S. Dept. of Commerce, "Electro-Kinetics," in Technologies of Delivery or Recovery for Remediation of Hazardous Waste Sites, pp. 25-30, University of Cincinnati, OH, Jan. 1990.

(Continued)

*Primary Examiner*—Michael C Wimer
(74) *Attorney, Agent, or Firm*—Moore & Hansen, PLLP

(57) ABSTRACT

Recovery of hydrocarbons, such as petroleum products, from a liquid or solid substrate is facilitated by the use of microwave energy to energize and separate molecular bonds between the hydrocarbons and the substrate. A radio frequency (RF) applicator delivers microwave energy to a treatment volume containing an emulsion of a hydrocarbon and a substrate. Delivering the microwave energy to the emulsion facilitates separation of the hydrocarbon and substrate molecules into layers. Hydrocarbons and other products can then be recovered from their respective layers. The treatment volume may be located either above or below ground. The RF applicator may include an antenna body with slots formed substantially parallel to one another in a substantially horizontal orientation. The RF applicator efficiently delivers microwave energy into the treatment volume. Substantially all of the power supplied to the RF applicator is radiated, with very little power reflected internally within the RF applicator.

30 Claims, 3 Drawing Sheets

U.S. PATENT DOCUMENTS

| | | | | |
|---|---|---|---|---|
| 3,133,592 | A | | 5/1964 | Tomberlin |
| 3,170,519 | A | | 2/1965 | Haagensen |
| 3,187,814 | A | | 6/1965 | McCarthy |
| 3,230,957 | A | | 1/1966 | Seifert |
| 3,632,945 | A | | 1/1972 | Johnson |
| 3,803,616 | A | | 4/1974 | Kopf et al. |
| 3,810,186 | A | | 5/1974 | Nakahara et al. |
| 3,818,333 | A | | 6/1974 | Walker |
| 3,848,671 | A | | 11/1974 | Kern |
| 4,008,765 | A | | 2/1977 | Anderson et al. |
| 4,135,579 | A | | 1/1979 | Rowland et al. |
| 4,140,179 | A | | 2/1979 | Kasevich et al. |
| 4,140,180 | A | | 2/1979 | Bridges et al. |
| 4,144,935 | A | | 3/1979 | Bridges et al. |
| 4,193,448 | A | | 3/1980 | Jeambey |
| 4,193,451 | A | | 3/1980 | Dauphine |
| RE30,378 | E | | 8/1980 | Bice et al. |
| 4,275,283 | A | | 6/1981 | Focht |
| 4,301,865 | A | | 11/1981 | Kasevich et al. |
| 4,398,597 | A | | 8/1983 | Haberman |
| 4,449,585 | A | | 5/1984 | Bridges et al. |
| 4,457,365 | A | | 7/1984 | Kasevich et al. |
| 4,485,868 | A | | 12/1984 | Sresty et al. |
| 4,485,869 | A | | 12/1984 | Sresty et al. |
| 4,508,168 | A | | 4/1985 | Heeren |
| 4,518,967 | A | * | 5/1985 | Westerman ..... 343/771 |
| 4,524,826 | A | | 6/1985 | Savage |
| 4,524,827 | A | | 6/1985 | Bridges et al. |
| 4,545,435 | A | | 10/1985 | Bridges et al. |
| 4,553,592 | A | | 11/1985 | Looney et al. |
| 4,583,589 | A | | 4/1986 | Kasevich |
| 4,612,940 | A | | 9/1986 | Kasevich et al. |
| 4,620,593 | A | | 11/1986 | Haagensen |
| 4,638,862 | A | | 1/1987 | Savage |
| 4,660,007 | A | | 4/1987 | Edwards et al. |
| 4,670,634 | A | | 6/1987 | Bridges et al. |
| 4,700,716 | A | | 10/1987 | Kasevich et al. |
| 4,705,108 | A | | 11/1987 | Little et al. |
| 4,765,406 | A | | 8/1988 | Frohling et al. |
| 4,765,902 | A | | 8/1988 | Ely et al. |
| 4,776,086 | A | | 10/1988 | Kasevich et al. |
| 4,805,698 | A | | 2/1989 | Baugh et al. |
| 5,018,576 | A | | 5/1991 | Udell et al. |
| 5,055,180 | A | | 10/1991 | Klaila |
| 5,065,819 | A | | 11/1991 | Kasevich |
| 5,152,341 | A | | 10/1992 | Kasevich |
| 5,255,742 | A | | 10/1993 | Mikus |
| 5,299,887 | A | | 4/1994 | Ensley |
| 5,420,402 | A | | 5/1995 | Bridges et al. |
| 5,474,129 | A | | 12/1995 | Weng et al. |
| 5,488,990 | A | | 2/1996 | Wadleigh et al. |
| 5,535,825 | A | | 7/1996 | Hickerson |
| 5,539,853 | A | | 7/1996 | Jamaluddin et al. |
| 5,852,424 | A | * | 12/1998 | Reineck et al. ..... 343/872 |
| 5,914,014 | A | | 6/1999 | Kartchner |
| 6,008,770 | A | * | 12/1999 | Sugawara ..... 343/767 |
| 6,077,400 | A | | 6/2000 | Kartchner |
| 6,086,830 | A | | 7/2000 | Kartchner |
| 6,583,394 | B2 | | 6/2003 | Araya et al. |
| 6,614,229 | B1 | * | 9/2003 | Clark et al. ..... 324/338 |

FOREIGN PATENT DOCUMENTS

| | | |
|---|---|---|
| EP | 0105677 | 4/1984 |
| GB | 1188490 | 4/1970 |

OTHER PUBLICATIONS

U.S. Dept. of Commerce, "Vapor Extraction," in Technologies of Delivery or Recovery for the Remediation of Hazardous Waste Sites, pp. 44-45, Univ. of Cincinnati, OH Jan. 1990.

Anderson, I. "Steam Cleaning Deals with Toxic Waste," New Scientist, p. 31, Nov. 1988.

Oma, K.H. et al., "In Situ Heating to Detoxify Organic-Contaminated Soils," Hazardous Material Control, pp. 14-19, Mar./Apr. 1989.

U.S. Dept. of Commerce, "Radio-Frequency Heating," in Technologies of Delivery or Recovery for the Remediation of Hazardous Waste Sites, pp. 66-67, University of Cincinnati, OH, Jan. 1990.

* cited by examiner

MICROWAVE DEMULSIFICATION OF HYDROCARBON EMULSION

RELATED APPLICATIONS

This application is a divisional of U.S. Ser. No. 10/619,011, filed Jul. 14, 2003 now U.S. Pat. No. 7,486,248.

FIELD OF THE INVENTION

The invention relates generally to hydrocarbon recovery techniques. More particularly, the invention relates to hydrocarbon recovery via application of microwave energy.

BACKGROUND OF THE INVENTION

Hydrocarbons, such as petroleum products, have been recovered from underground media, such as oil shale, tar sand, and ground water contamination, using a variety of techniques, including heat and chemical treatment. As is well known in the art, heating the petroleum products reduces their viscosity, facilitating extraction from the medium. Various techniques have been proposed for heating the petroleum products. For instance, a geologic formation can be heated via electrodes deployed in the ground using resistance heating. As an alternative, the geologic formation can be heated by steam that is either delivered to the geologic formation or formed within the geologic formation.

Microwave energy can also be used to generate heat for extracting petroleum products from an underground medium. Generally, microwave techniques use an elongate antenna that is located below ground level, typically within a borehole, at the site where heating is desired. A radio frequency (RF) generator, such as a magnetron or a klystron generator, generates an RF signal, which typically contains microwave energy. A coaxial transmission line or other waveguide transmits the RF signal from the RF generator to the antenna, which radiates the RF signal to the surrounding environment, i.e., the underground medium.

The antenna delivers microwave energy to the underground medium, heating the petroleum products. As a result, the viscosity of the hydrocarbons is lowered, which in turn reduces the pumping power involved in extracting the petroleum products. Further, the mobility of the petroleum products in the medium is increased relative to the mobility of water in the medium, reducing the amount of water that is extracted by pumping.

The use of microwave energy to heat and remove hydrocarbons from other environments, such as oil-based emulsions, has also been proposed. For example, in some conventional techniques, a hydrocarbon and water emulsion flows through a microwave cavity having emulsion flow chambers. These chambers, in combination with a microwave waveguide, form a resonant chamber within which microwave energy reflects to treat the flowing emulsion.

While microwave treatment of emulsions can separate the emulsions to some degree, certain drawbacks of some conventional approaches limit the effectiveness of those approaches. For example, the heat generated in the process may be sufficient to ignite nearby materials, such as explosive gas byproducts or the hydrocarbons themselves. Cooling systems or explosion suppression systems are often required to reduce the likelihood of explosion. One technique to suppress ignition and reduce the likelihood of explosion is disclosed in U.S. Pat. No. 5,829,528, issued Nov. 3, 1998 to Uthe, entitled IGNITION SUPPRESSION SYSTEM FOR DOWN HOLE ANTENNAS, the disclosure of which is hereby incorporated herein by reference in its entirety.

Further, in approaches in which microwave energy is emitted from a source above the emulsion, the microwave energy often does not penetrate adequately deeply to treat the entire emulsion. Only a portion of the emulsion, such as a surface layer, is heated effectively, potentially resulting in inefficient demulsification. Even in approaches in which microwave energy is applied via an antenna inserted in a borehole, many antennas do not radiate the microwave energy effectively. As a result, such antennas typically consume relatively large amounts of power, leading to high costs. In addition, a substantial portion of the microwave energy not radiated is internally reflected within the antenna, potentially resulting in heating of the antenna itself and an elevated risk of combustion as described above.

SUMMARY OF THE DISCLOSURE

According to various example implementations of the present invention, a microwave applicator delivers microwave energy to a treatment volume containing an emulsion of a hydrocarbon and a substrate. The treatment volume may be located either above or below ground. For example, the treatment volume may be a treatment tank or an underground medium located near a down hole or bore hole, such as a geologic formation containing oil shale, tar sand, or ground water contamination. Delivering the microwave energy to the emulsion imparts energy to electrons and molecular bonds between the hydrocarbon and the substrate. The molecular bonds separate as a result, facilitating demulsification of the hydrocarbon from the substrate.

In one implementation, a radio frequency (RF) applicator includes an antenna body. The antenna body has a longitudinal axis and an outer surface defining a plurality of slots. The slots are substantially parallel to one another and substantially perpendicular to the longitudinal axis.

Another implementation is directed to a demulsification arrangement that includes a power source and a containment structure adaptable to receive an emulsion comprising a microwave-absorptive material and a substrate. An RF is applicator operatively coupled to the power source and positioned within the containment structure to deliver microwave energy. The RF applicator includes an antenna body having a longitudinal axis and an outer surface defining a plurality of slots. The slots are substantially parallel to one another and substantially perpendicular to the longitudinal axis. When the containment structure contains the emulsion and the applicator delivers the microwave energy into the treatment volume, the microwave-absorptive material and the substrate are demulsified.

Another implementation is directed to a demulsification arrangement in which a radio frequency (RF) generator, operatively coupled to a power source, is configured to generate an RF signal. A control arrangement is configured to be operatively coupled to the RF generator to control generation of the RF signal. An RF applicator is configured to be operatively coupled to the RF generator. The RF applicator is positioned in a treatment volume containing an emulsion comprising a microwave-absorptive material and a substrate to transmit the RF signal. The RF applicator includes an antenna body having a longitudinal axis and an outer surface defining a plurality of slots that are substantially parallel to one another and substantially perpendicular to the longitudinal axis. When the control arrangement, the RF applicator, and the RF generator are operatively coupled and the RF applicator transmits the RF signal into the treatment volume, the microwave-absorptive material and the substrate are demulsified.

Various implementations may provide certain advantages. With the slots oriented substantially perpendicular to the longitudinal axis, the RF applicator efficiently delivers microwave energy into the treatment volume. Substantially all of the power supplied to the RF applicator is radiated into the treatment volume, with very little power reflected internally within the RF applicator. Energy costs are reduced as a result. Further, relatively little heat is generated within the RF applicator, greatly reducing the need to cool the RF applicator. In addition, higher levels of microwave energy can be used to demulsify the emulsion, resulting in more effective demulsification with less heat generated within the RF applicator itself.

Additional advantages and features of the present invention will become apparent from the description and the claims that follow, considered in conjunction with the accompanying drawings.

DETAILED DESCRIPTION OF VARIOUS EMBODIMENTS

Figure 1:
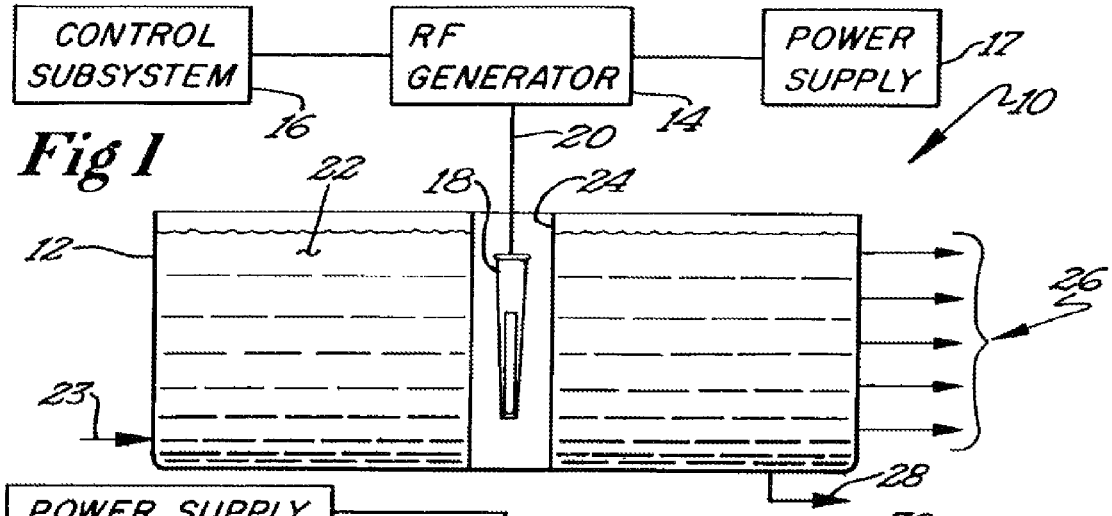
FIG. 1 is a system diagram illustrating an example demulsification system operable in connection with a contained treatment volume.

Various embodiments of a demulsification system facilitate recovery of hydrocarbons, such as petroleum products, from a liquid or solid substrate by using microwave energy to energize and separate molecular bonds between the hydrocarbons and the substrate. A microwave applicator delivers microwave energy to a treatment volume containing an emulsion of a hydrocarbon and a substrate. Delivering the microwave energy to the emulsion imparts energy to electrons and molecular bonds between the hydrocarbon and the substrate. As a result, the hydrocarbon and substrate molecules separate into strata or layers. Hydrocarbons and other products can then be recovered from their respective layers. The treatment volume may be located either above or below ground. For example, the treatment volume may be a treatment tank or a medium located near a down hole or bore hole, such as a geologic formation containing oil shale, tar sand, or ground water contamination.

In one implementation, a radio frequency (RF) applicator includes an antenna body with slots formed substantially parallel to one another. The slots have a substantially transverse orientation relative to the longitudinal axis of the antenna body. That is, the slots are substantially horizontal when the longitudinal axis of the antenna body is in a vertical orientation. With the slots oriented in this way, the RF applicator efficiently delivers microwave energy into the treatment volume. Much of the power supplied to the RF applicator is radiated into the treatment volume, with very little power reflected within the RF applicator and thus wasted. With a decreased amount of wasted energy, a greater portion of the energy supplied to the RF applicator is actually used to demulsify the emulsion. Overhead and, in turn, energy costs are reduced as a result. Further, relatively little heat is generated within the RF applicator, greatly reducing the need to cool the RF applicator. In addition, higher levels of microwave energy can be used to demulsify the emulsion, resulting in more effective demulsification with less heat generated within the RF applicator itself.

The following description of various embodiments implemented in demulsifying emulsions of hydrocarbons and water is to be construed by way of illustration rather than limitation. This description is not intended to limit the invention or its applications or uses. For example, while various embodiments of the invention are described as being implemented in demulsifying emulsions of hydrocarbons and water, it will be appreciated that the principles of the invention can be employed in other applications. For example, various embodiments can be used to demulsify other types of emulsions, including emulsions in which a material that absorbs microwave energy is emulsified with a liquid or solid substrate.

In the following description, numerous specific details are set forth in order to provide a thorough understanding of various embodiments of the present system and method. It will be apparent to one skilled in the art that the present system and method may be practiced without some or all of these specific details. In other instances, well known components and process steps have not been described in detail in order to avoid unnecessarily obscuring the present disclosure.

Referring now to the drawings, FIG. 1 illustrates an example demulsification system 10 operable in connection with a contained treatment volume 12. The contained treatment volume 12 may be contained, for example, within a storage tank located on the ground or mountable on a truck. By way of example and not limitation, the storage tank can be implemented as a conventional "frak" type tank having dimensions of approximately 8' in height, 8' in width, and 40' in length and having a storage capacity of approximately 12,000 gallons. It will be appreciated by those of skill in the art, however, that the storage tank may have any of a variety of shapes, dimensions, and storage volumes. For example, the storage tank may be implemented as a substantially larger tank having a storage capacity of 40,000-50,000 gallons. A radio frequency (RF) generator 14 controlled by a control subsystem 16 generates an RF signal, preferably a microwave signal. An applicator 18 is operatively coupled to the RF generator 14 by, for example, a waveguide 20. The waveguide 20 preferably is formed of a material that can effectively transmit the RF signal, e.g., a metal such as copper, aluminum, or stainless steel. The waveguide 20 can have any of a variety of shapes. Alternatively, the applicator 18 may be operatively coupled to the RF generator 14 by a coaxial transmission line or other suitable RF signal conduit. While not required, the applicator 18 may be swivel-mounted so as to be rotatable about its longitudinal axis.

When the RF generator 14 generates an RF signal, the waveguide 20 transmits the RF signal to the applicator 18. The applicator 18 then radiates the RF signal, which contains microwave energy, into an emulsion 22 stored in the contained treatment volume 12. As shown in the example of FIG. 1, the applicator 18 is inserted in a tube 24 disposed within the contained treatment volume 12. Inserting the applicator 18 in the tube 24 facilitates more effective penetration of the microwave energy into the emulsion 22 relative to some conventional treatment systems in which an applicator is located externally to, e.g., above, the material to be treated.

The microwave energy delivered by the applicator 18 interacts with the constituents of the emulsion 22, weakening the molecular bonds that maintain emulsification of the constituents. In an emulsion of hydrocarbons and water, for example, the microwave energy weakens the molecular bonds between hydrocarbon molecules, water molecules, and surfactant molecules. Application of a sufficient power level of microwave energy to the emulsion 22 causes these molecular bonds to be broken, facilitating separation of the hydrocarbons and the water.

The effect of the microwave energy on the emulsion 22 depends on the frequency and power level of the microwave energy. Accordingly, the applicator 18 is configured to radiate microwave energy that has a frequency or frequencies that are selected to break the molecular bonds effectively. As described more fully below in connection with FIGS. 3-6, the applicator 18 includes an antenna in which slots are formed. The sizes and configuration of the slots are selected to promote radiation of an effective frequency or frequencies of microwave energy.

The slots are preferably formed horizontally on two surfaces of the antenna. That is, the slots are formed in a direction perpendicular to the longitudinal axis of the antenna. Forming the slots horizontally, rather than vertically as in some conventional antennas, enables the applicator 18 to radiate substantially all of the microwave energy into the contained treatment volume 12. By contrast, some conventional antennas exhibit internal reflection of the microwave energy. Such internal reflection may have a number of adverse effects. Reflection of microwave energy within an antenna potentially results in undesirable heating of the antenna, increasing the risk of igniting materials in the environment, such as explosive gases. In addition, microwave energy that is converted to heat within the antenna in this way is not radiated into the treatment volume and is essentially wasted. By substantially eliminating internal reflection of microwave energy, the applicator 18 generates significantly less heat relative to some conventional microwave antennas. Further advantageously, the applicator 18 radiates substantially all of the energy it receives from the RF generator 14 into the contained treatment volume 12, significantly improving the energy efficiency of the process.

While ignition of materials in the environment by the applicator 18 is unlikely, the characteristics and performance of the antenna may be affected by ingress of fluids or gases into the applicator 18. Accordingly, it is desirable to prevent substantial ingress of fluids or gases into the applicator 18. The applicator 18 preferably is encapsulated within an enclosure that at least nearly provides a hermetic seal from fluids and gases. This enclosure can be formed from any of a variety of materials, including, for example, fiberglass or silicone. Other suitable materials noted in the art include TEFLON® polytetrafluoroethylene (PTFE), low dielectric ceramics, and polyethylene.

In some implementations, the antenna may be tapered from one end to the other. For example, the antenna width at one end proximate to the waveguide 20 may be greater than the antenna width at another end distal to the waveguide 20. Tapering the antenna in this way amplifies the RF signal at the distal end of the antenna to counteract attenuation of the RF signal as it is propagated along the length of the antenna. Efficient radiation of microwave energy into substantially the entire contained treatment volume 12 is facilitated as a result. In this way, the applicator 18 effectively demulsifies substantially the entire emulsion 22 as described above.

As the emulsion 22 is demulsified, it separates into layers or strata according to the specific gravities of the components of the emulsion 22. Components having relatively low specific gravities, such as hydrocarbons, occupy strata closest to the surface of the emulsion 22. Conversely, components having higher specific gravities, such as water and other substrates, occupy lower strata. The components having the highest specific gravities, such as solids, settle to the bottom of the contained treatment volume 12. The duration of the application of microwave energy depends on a number of considerations, including, for example, the nature of the emulsion 22, and the power level of the microwave energy. As an illustrative example, the contents of a standard "frak" type tank can be demulsified within 4-12 hours with an applied power of 30 kW, depending on the complexity of the emulsion 22.

Outlet ports 26 are disposed along a wall of the contained treatment volume 12. After the emulsion 22 has been demulsified, the outlet ports 26 can be tapped to extract the desired components. While FIG. 1 illustrates five outlet ports 26, the contained treatment volume 12 may have more or fewer outlet ports 26. For some applications, for example, a single outlet port 26 to extract hydrocarbons near the surface of the emulsion 22 may be sufficient. In other applications, the contained treatment volume 12 may omit the outlet ports. In such applications, tubes may be inserted within the contained treatment volume 12 for pumping the hydrocarbons out of the contained treatment volume 12. Water may be removed via a water purification system, and solid substrates may be removed by shoveling or other suitable removal techniques well known to those of skill in the art. It will be appreciated that hydrocarbons, water, and solid substrates may be removed during, rather than after, demulsification in a continuous process.

Figure 2:
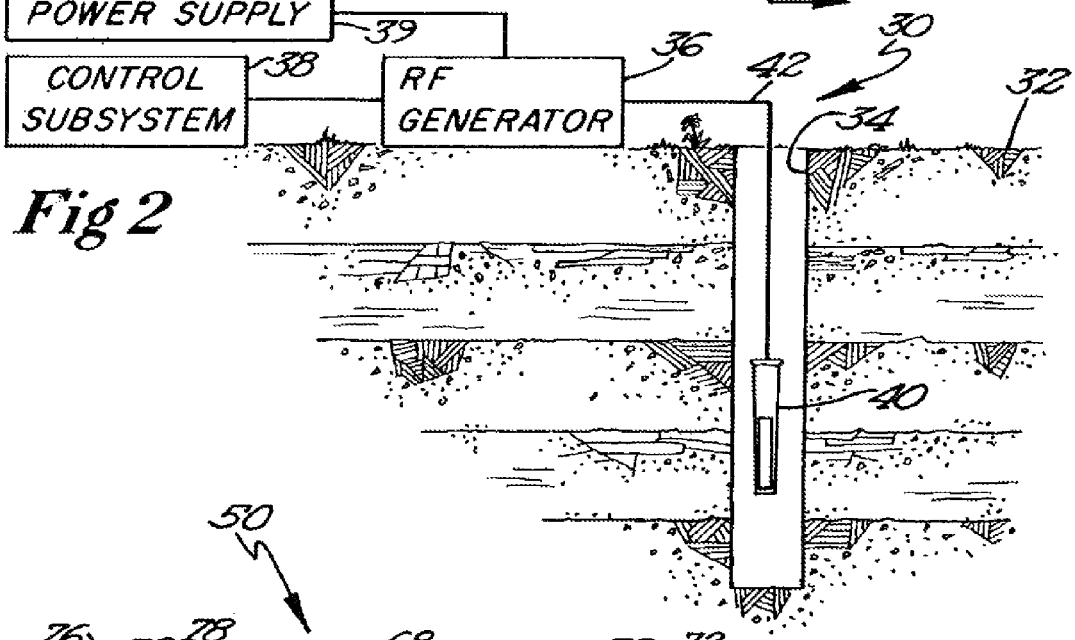
FIG. 2 is a system diagram illustrating an alternate example demulsification system operable in connection with an underground treatment volume.

FIG. 2 is a system diagram illustrating another example demulsification system 30 operable in connection with an uncontained treatment volume. While the uncontained treatment volume is depicted in FIG. 2 as a geologic formation 32 in the earth, the principles of the present invention can be applied to a variety of environments, including but not limited to, for example, oil spills, contaminated aquifers, and tar sands.

In the implementation shown in FIG. 2, a borehole 34 extends down into the geologic formation 32. A radio frequency (RF) generator 36 controlled by a control subsystem 38 generates an RF signal, preferably a microwave signal. An applicator 40 is operatively coupled to the RF generator 36 by, for example, a waveguide 42. The waveguide 42 preferably is formed of a material that can effectively transmit the RF signal, e.g., a metal such as copper, aluminum, or stainless steel, and can have any of a variety of shapes. Alternatively, the applicator 40 may be operatively coupled to the RF generator 36 by a coaxial transmission line or other suitable RF signal conduit. The waveguide 42 preferably has an upper end that is positioned adjacent ground level so the operator can access the device without undue difficulty. The applicator 40 preferably is positioned within the borehole 34 adjacent the area to be treated. For example, the applicator 40 may be positioned 100-200 feet deep in the borehole 34. The depth at which the applicator 40 is positioned is limited only by the length of the waveguide 42. As will be well understood by those in the art, the upper end of the waveguide 42 is usually not precisely at ground level. Rather, the upper end can be several feet below the level of the adjacent ground or, more typically, extend several feet above the level of the adjacent ground to enable easier access to any necessary fittings.

Accordingly, when the upper end or any other structure is said to be "adjacent ground level," it should be understood that this is a relative term and does not require the relevant structure be precisely aligned with the adjacent ground.

When the RF generator 36 generates an RF signal, the waveguide 42 transmits the RF signal to the applicator 40. The applicator 40 then radiates the RF signal, which contains microwave energy, into the geologic formation 32. The microwave energy interacts with the constituents of the geologic formation 32, which may include, for example, hydrocarbons, water, and other liquid and solid substrates in any combination. As described above in connection with FIG. 1, the microwave energy weakens the molecular bonds between the hydrocarbons, substrates, and surfactants. If the microwave energy has sufficient power, the molecular bonds are broken, facilitating separation of the hydrocarbons from the substrate materials.

The effect of the microwave energy on the geologic formation 32 depends on the frequency and power of the microwave energy. Accordingly, the applicator 40 is configured to radiate microwave energy having sufficient power and having a frequency or frequencies that are selected to break the molecular bonds effectively. As described more fully below in connection with FIGS. 3-6, the applicator 40 includes an antenna in which slots are formed. The sizes and configuration of the slots are selected to promote radiation of an effective frequency or frequencies of microwave energy.

The slots are preferably formed horizontally on two surfaces of the antenna. That is, the slots are formed in a direction perpendicular to the longitudinal axis of the antenna. Forming the slots horizontally, rather than vertically as in some conventional antennas, enables the applicator 40 to radiate substantially all of the microwave energy into the geologic formation 32. Internal reflection of microwave energy is substantially eliminated. Accordingly, the applicator 40 generates significantly less heat relative to some conventional microwave antennas. Further advantageously, the applicator 40 radiates substantially all of the energy it receives from the RF generator 36 into the geologic formation 32, significantly improving the energy efficiency of the process.

While ignition of materials in the environment by the applicator 40 is unlikely, the characteristics and performance of the antenna may be affected by ingress of fluids or gases into the applicator 40. Accordingly, it is desirable to prevent substantially ingress of fluids or gases into the applicator 40. The applicator 40 preferably is encapsulated as described above in connection with FIG. 1. Suitable materials noted in the art for encapsulating the applicator 40 include silicone, fiberglass, TEFLON® PTFE, low dielectric ceramics, and polyethylene. Further, while not required, the applicator 40 may be further protected from ingress of gases and fluids by a supply of a gas positioned adjacent ground level. Examples of suitable gases include anaerobic gases such as carbon dioxide or nitrogen. Anaerobic gases limit the amount of available oxygen and, hence, further reduce the likelihood of combustion in the borehole 34. The gas may be supplied in the form of a cold liquid, such as liquid nitrogen, or even a solid, such as frozen carbon dioxide. More commonly, though, the gas is supplied from a pressurized tank or the like positioned on the ground or in a vehicle adjacent the top of the borehole 34. A regulator (not shown) preferably delivers the gas at a constant, controlled rate.

In some implementations, the antenna may be tapered from one end to the other. For example, the antenna width at one end proximate to the waveguide 42 may be greater than the antenna width at another end distal to the waveguide 42. Tapering the antenna in this way amplifies the RF signal at the distal end of the antenna to counteract attenuation of the RF signal as it is propagated along the length of the antenna. Efficient radiation of microwave energy into substantially the entire geologic formation 32 is facilitated as a result. In this way, the applicator 40 effectively demulsifies substantially the entire geologic formation 32 as described above. For example, the applicator 40 can radiate enough microwave energy to recover hydrocarbons within a radius of the applicator on the order of 1700 feet.

As the geologic formation 32 is demulsified, strata or layers form according to the specific gravities of the components of the geologic formation 32. Components having relatively low specific gravities, such as hydrocarbons, occupy strata closest to the top of the geologic formation 32. Conversely, components having higher specific gravities, such as water and other substrates, occupy lower strata. The desired recovered components can then be extracted using any of a number of extraction techniques that are well known in the art, such as pumping.

Figure 3:
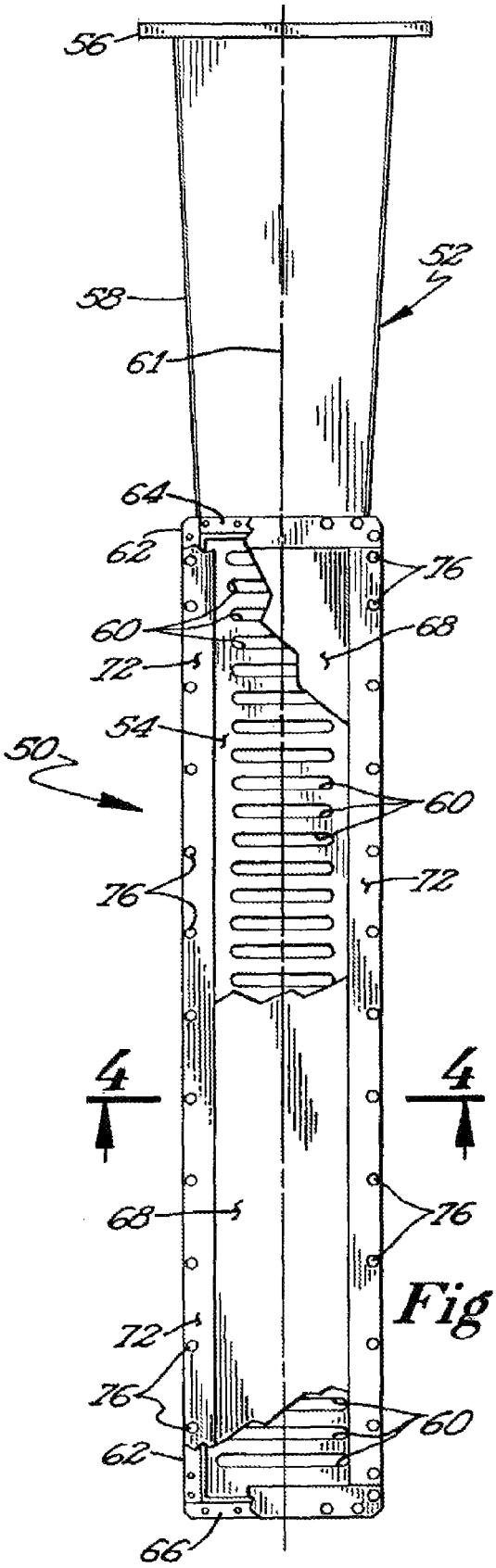
FIG. 3 is a plan view illustrating an example microwave energy applicator.

FIG. 3 is a plan view illustrating an example microwave energy applicator 50. The microwave energy applicator 50 includes a transition module 52 and an antenna body 54. In an example embodiment, the transition module 52 is approximately 2 feet long and the antenna body 54 is approximately 4 feet long.

The transition module 52 includes a flange 56 that is coupled to a waveguide, such as the waveguide 20 of FIG. 1 or the waveguide 42 of FIG. 2. The flange 56 preferably is implemented using a conventional waveguide flange, such as a WR975 type flange. A WR975 type flange is a conventional 915 MHz waveguide having inner dimensions of 9¾" by 4⅞". The flange 56 is coupled to the antenna body 54 via a member 58, which preferably is formed from ⅛" thick aluminum walls. The construction of the member 58 in this implementation is illustrated in and described more fully in connection with FIG. 6.

The antenna body 54 may be formed from any of a variety of materials, including, but not limited to, an aluminum WR770 type waveguide material. A WR770 type waveguide material has a quadrilateral, e.g., rectangular, cross-section with inner dimensions of 3¾" by 7½". The antenna body 54 has a longitudinal axis and an outer surface. Slots 60 are formed on the outer surface substantially parallel to one another. The slots 60 are oriented substantially horizontally, i.e., substantially perpendicular to the longitudinal axis of the antenna body 54. In one implementation, the slots 60 are formed along substantially the entire length of the antenna body 54. The size and configuration of the slots 60 are preferably selected to facilitate radiation of microwave energy having a particular frequency or frequencies selected for excitation of the molecular bonds between surfactant molecules and hydrocarbon or substrate molecules. In one implementation, the size and configuration of the slots 60 are selected to facilitate radiation of microwave energy having a frequency of approximately 915 MHz. One particular configuration of the slots 60 is provided below in Table 1 in connection with FIG. 5.

The slots 60 preferably are formed on two parallel faces of the antenna body 54. While not required, the other two parallel faces of the antenna body 54 are preferably not slotted. In this example implementation, the slots 60 facilitate radiation of microwave energy over approximately a 135° arc outward from each group of slots 60, i.e., from each of the two parallel faces having slots formed thereon. Accordingly, the microwave energy applicator 50 radiates microwave energy over an approximately 270° range. Limiting the radiation to this range substantially eliminates destructive interference between the microwaves, resulting in a relatively uniform radiation pattern over the approximately 270° range. To obtain a full 360° range of coverage, the contained treatment volume 12 may be rotated 90° during the demulsification process. Alternatively, the applicator may be swivel-mounted on the waveguide 42 so that the applicator itself may be rotated 90°. As another alternative, the slots 60 may be formed on all four faces of the antenna body 54 to radiate microwave energy substantially over a 360° range, but the energy thus radiated may be characterized by a less uniform radiation pattern, such as areas of reduced intensity due to destructive interference between microwaves.

Side walls 62 are located proximate each of four corners of the antenna body 54. The side walls 62 are preferably formed of an RF opaque material, such as aluminum. The side walls 62 extend approximately ½" over the slots 60 so as to facilitate insertion of RF transparent windows as depicted in and described in connection with FIG. 4. A bar 64 formed from, for example, ½" aluminum, is welded on the antenna body 54. An end cap 66, also formed from ½" aluminum, is coupled to an end of the antenna body 54 distal from the flange 56.

The RF transparent windows allow microwave energy to pass through uninhibited while protecting the antenna body 54 from substantial ingress of gases or fluids. To further protect the antenna body 54 from substantial ingress of gases or fluids, an antenna enclosure may be formed proximate the antenna body 54 to substantially seal the antenna body 54 from an environment external to the RF applicator. The antenna enclosure may be formed from a material having a low dielectric constant, preferably similar to the dielectric constant of the RF transparent window arrangement. For example, the antenna enclosure may be formed from fiberglass.

Figure 4:
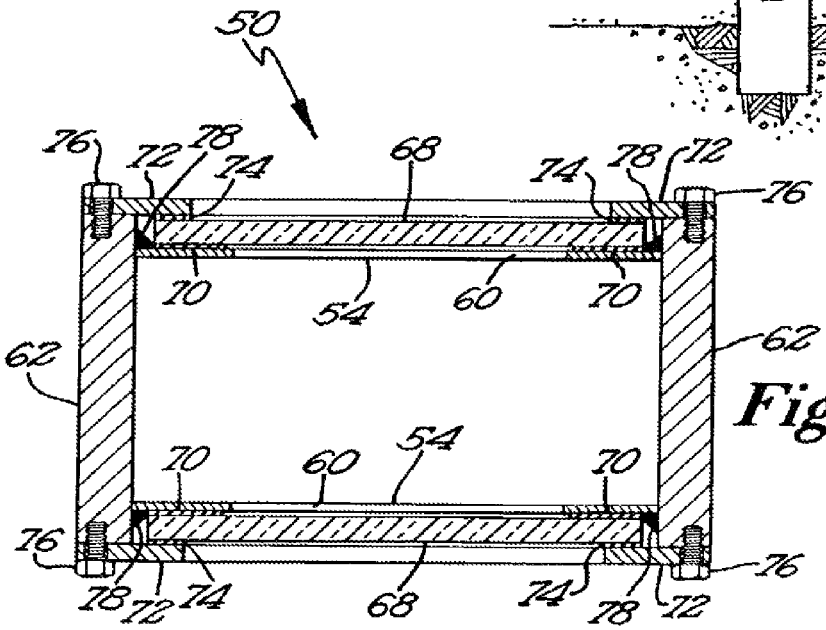
FIG. 4 is a cross-sectional view taken across section 4-4 of FIG. 3.

FIG. 4 is a cross-sectional view taken across section A-A of FIG. 3. As shown in FIG. 4, the side walls 62 are arranged to facilitate the insertion of RF transparent windows 68 over the antenna body 54, spaced apart from the antenna body by gaskets 70. The RF transparent windows 68 are formed from a material having a low dielectric constant, such as fiberglass or TEFLON® PTFE. Bars 72 and gaskets 74 secure the RF transparent windows 68. An example implementation of a bar 72 is depicted in and described in connection with FIG. 7. Bolts 76 secure the bars 72 to the side walls 62. Alternatively, machine screws or other fasteners can be used to secure the bars 72 to the side walls 62. Silicone 78 can be used to fill voids to provide a substantially watertight and airtight seal.

Figure 5:
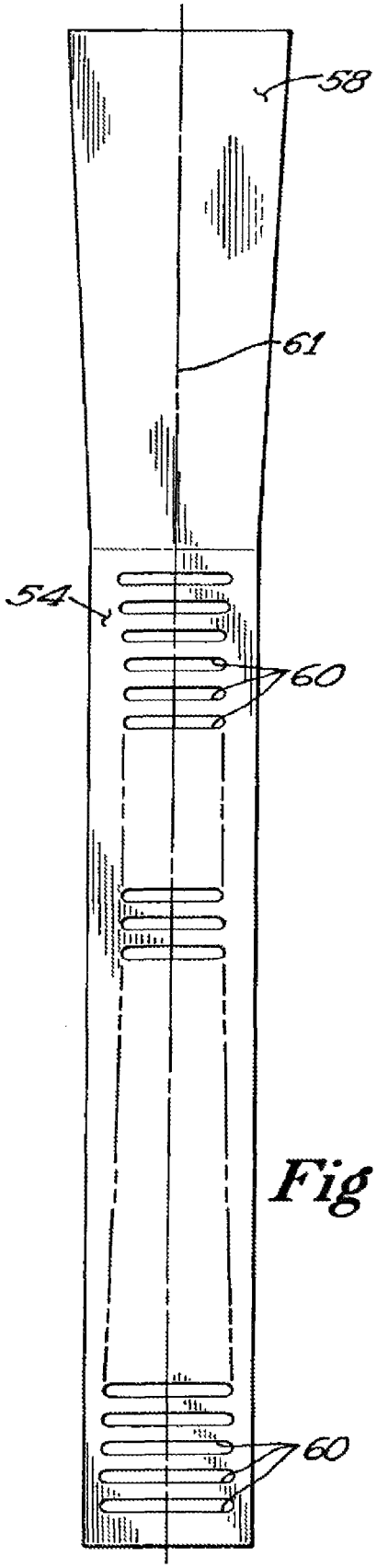
FIG. 5 is a plan view illustrating a portion of the microwave energy applicator of FIG. 3.

FIG. 5 is a plan view illustrating an example implementation of the antenna body 54 and the member 58. As described above in connection with FIG. 3, the antenna body 54 may be formed from an aluminum WR770 type waveguide material having inner dimensions of 3¾" by 7½". In the implementation shown in FIG. 5, the antenna body 54 is formed integrally with the member 58 as a unitary module having an overall length of 6 feet. The width of this unitary module is illustrated as tapered from 9¾" at one end proximate the flange 56 to 7½" at another end distal from the flange 56. As an alternative, the antenna body 54 and the member 58 can be constructed as distinct components.

The antenna body 54 has an outer surface defining a number of slots 60. These slots 60 have a substantially horizontal orientation and are substantially parallel to one another. In one implementation, the size and configuration of the slots are selected to facilitate radiation of microwave energy having a frequency of approximately 915 MHz. One particular configuration of slots is provided below in Table 1. In Table 1, the slots 60 are identified by slot numbers, in which slot number 1 corresponds to the slot closest to the flange 56 and slot number 33 corresponds to the slot most distant from the flange 56. Slot number 1 may be located, for example, approximately 25¾" from the flange 56. The remaining slots may be located along the portion of the unitary module forming the antenna body 54 spaced approximately 1⅜" apart from one another so as to be distributed along substantially the entire length of the antenna body 54.

TABLE 1

| Slot Number | Width (inches) |
|---|---|
| 1 | 5⅛ |
| 2 | 4⅞ |
| 3 | 4⅝ |
| 4 | 4 9/16 |
| 5 | 4 9/16 |
| 6 | 4 17/32 |
| 7 | 4 17/32 |
| 8 | 4 17/32 |
| 9 | 4 17/32 |
| 10 | 4½ |
| 11 | 4 9/16 |
| 12 | 4 9/16 |
| 13 | 4⅝ |
| 14 | 4⅝ |
| 15 | 4 11/16 |
| 16 | 4 11/16 |
| 17 | 4 11/16 |
| 18 | 4⅞ |
| 19 | 5 |
| 20 | 5⅛ |
| 21 | 5⅛ |
| 22 | 5¼ |
| 23 | 5⅜ |
| 24 | 5 7/16 |
| 25 | 5 9/16 |
| 26 | 5 19/32 |
| 27 | 5 11/16 |
| 28 | 5 25/32 |
| 29 | 5 13/16 |
| 30 | 5⅞ |
| 31 | 5 15/16 |
| 32 | 6 |
| 33 | 6 1/16 |

Figure 6:
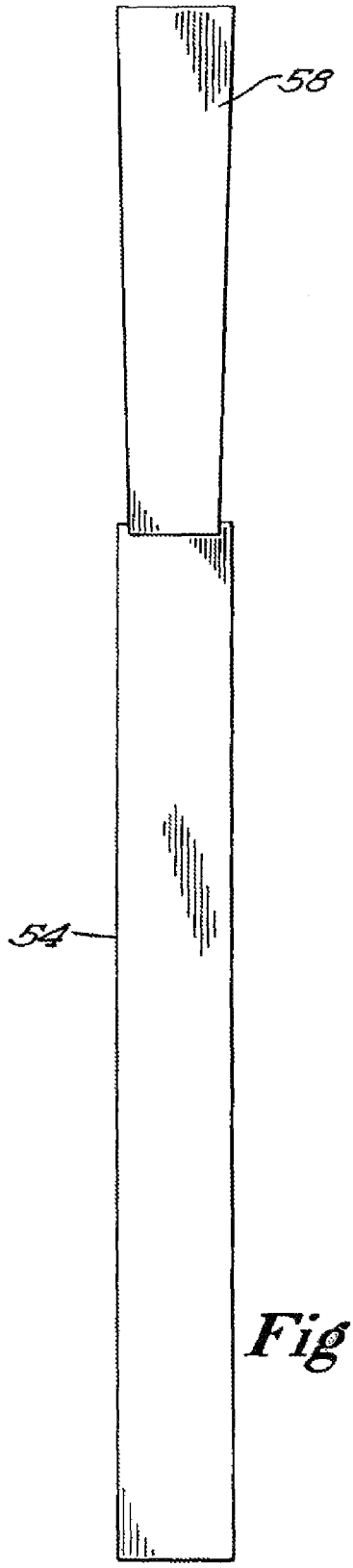
FIG. 6 is a side view illustrating the portion of the microwave energy applicator depicted in FIG. 5.

FIG. 6 is a side view illustrating the antenna body 54 and the member 58 of FIG. 5. As shown in FIG. 6, the member 58 may be tapered. For example, the depth of the member 58 may vary from 5⅛" at the end proximate the flange 56 to 4" at the end proximate the antenna body 54. The antenna body 54, on the other hand, is illustrated as having a substantially uniform depth of 5".

Figure 7:
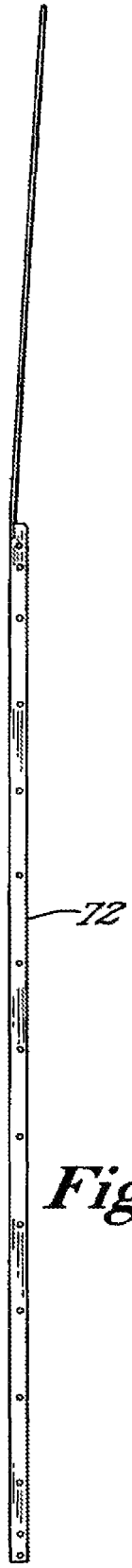
FIG. 7 is a plan view illustrating an example implementation of one component of the microwave energy applicator of FIG. 3.

FIG. 7 is a plan view illustrating an example implementation of a bar 72 of FIG. 4. As described above in connection with FIG. 4, the bars 72 secure the RF transparent windows 68 in place. More particularly, the bars 72 clamp the RF transparent windows 68 over the antenna body 54, providing a substantially watertight and airtight seal to prevent substantial ingress of gases and fluids from the external environment. The bar 72 preferably is ¾" wide and, when installed, hangs over an inner edge of the side wall 62 by approximately ¼". The bar 72 may be secured to the side wall 62 by bolts.

In operation, an RF signal is provided from an RF signal generator, such as the RF generator 14 of FIG. 1 or the RF generator 36 of FIG. 2, to the microwave energy applicator 50. The RF signal enters the microwave energy applicator 50 through the flange 56 and travels down the member 58. When the RF signal enters the antenna body 54, a portion of the microwave energy contained in the RF signal is radiated from the first slot, i.e., the slot designated as slot number 1 in Table 1 above. The remainder of the microwave energy is propagated down the antenna body 54. A portion of the microwave energy radiates from each successive slot, attenuating the RF signal as the RF signal propagates down the antenna body 54. To counteract this attenuation, the antenna body 54 preferably is tapered so as to amplify the RF signal as it propagates down the antenna body 54. When the RF signal reaches the end cap 66, it is reflected by the end cap 66 back toward the flange 56. The length of the antenna body 54 and, consequently, the location of the end cap 66, are selected to promote constructive interference of the reflected microwaves. That is, as the microwaves are reflected up the antenna body 54 toward the flange 56, they reinforce rather than cancel the microwaves propagating down the antenna body 54.

The microwaves emitted by the microwave energy applicator 50 contain photons that deliver energy to the emulsion. The hydrocarbon molecules, substrate molecules, and surfactant molecules have different absorptive properties with respect to the photons. Each type of molecule has a range of frequencies it will absorb and emit based on the atoms included in the molecule and the types of bonding occurring within the molecule. In the case of hydrocarbon molecules, which are considerably more complex than either substrate or surfactant molecules, the absorption spectrum substantially coincides with the frequency of the applied RF energy.

When a hydrocarbon molecule absorbs a photon, the electrons in the hydrocarbon molecule absorb the energy carried by the photon and move to a higher energy level. The electrons then emit a photon and return to their previous energy levels. The amount of energy absorbed and released by the electrons is not sufficient to effect any noticeable increase in temperature. However, this absorption imparts sufficient energy to break weak bonds within the hydrocarbon molecule, thereby changing the specific gravity of the hydrocarbon molecule. Further, the energy imparted may be sufficient to break weak bonds between the hydrocarbon molecule and a substrate molecule to which it may be attached, allowing the hydrocarbon molecule to migrate.

When the hydrocarbon molecules gain energy and release from the substrate, they begin to move until they emit their energy and reattach to substrate. If they move sufficiently far from the microwave energy applicator 50 to be unable to absorb photons to raise the electrons to higher energy levels, the hydrocarbon molecules remain motionless. However, if the hydrocarbon molecules move toward the microwave energy applicator 50, emitting the energy leaves the hydrocarbon molecules within an energy zone where they can again absorb energy and continue moving. The process continues until the hydrocarbon molecules randomly find their way to an outlet, such as a pumping well, and are removed or are trapped, for example, by a vacuum system. The only molecules that will not eventually be trapped by this system are molecules that are too far from the microwave energy applicator 50 to absorb the necessary photons. With 75 kW of energy applied, for example, hydrocarbon molecules up to approximately 1700 feet away from the microwave energy applicator 50 can absorb sufficient energy to effect migration. Molecules at the outer edge of this range have a 75% chance of moving into this energy zone. Molecules within the energy zone have an almost 100% chance of being captured given sufficient time and the porosity of the substrate to allow the molecules to migrate to the pumping wells.

The demulsification technique is particularly efficient at recovering hydrocarbons from porous materials with a water table below the contamination. With a water table below the contamination, hydrocarbon molecules are less likely to migrate down, away from the microwave applicator 50. If the substrate has high porosity, the hydrocarbon molecules will encounter relatively little resistance as they migrate toward the outlet. As a result, the hydrocarbon molecules will tend to migrate relatively large distances before emitting their energy. If the hydrocarbon pollution is above the water, the effective range will be sufficiently increased because less water will be present to absorb the energy, making more energy available to be imparted to the hydrocarbon molecules.

As demonstrated by the foregoing discussion, various implementations of the present invention may provide certain advantages. Because the microwave energy is used to separate the molecular bonds between the hydrocarbon and the substrate, it is not necessary to heat the emulsion to the degree involved in heat-based separation techniques. Consequently, higher levels of microwave energy can be used to demulsify the emulsion, resulting in more effective demulsification. The effective operating range of the applicator is improved relative to some conventional techniques. For example, it has been demonstrated that the techniques disclosed in the present application can be used to treat an underground medium having a radius of 1700 feet. Moreover, the need to cool the applicator is substantially reduced.

It will be understood by those who practice the invention and by those skilled in the art that various modifications and improvements may be made to the invention without departing from the spirit and scope of the disclosed embodiments. For example, while the applicator has been illustrated and described as having a generally rectangular cross-section, the applicator may have a different type of cross-sectional shape, such as a circular cross-section. The scope of protection afforded is to be determined solely by the claims and by the breadth of interpretation allowed by law.

What is claimed is:

1. A radio frequency (RF) applicator comprising a single antenna body having a longitudinal axis and proximal and distal ends, the antenna body being tapered in width perpendicular to the longitudinal axis such that the width decreases from the proximal to the distal end of the antenna body, a length and two outer surfaces, with each outer surface defining a group of slots of continuously varying slot width that are substantially parallel to each other, and with each group of slots being distributed along and substantially perpendicular to the longitudinal axis.

2. The RF applicator of claim 1, in which the antenna body comprises a plurality of faces forming a quadrilateral cross-section that defines an interior space.

3. The RF applicator of claim 2, in which the plurality of faces form a rectangular cross-section.

4. The RF applicator of claim 1, in which the antenna body comprises two walls formed from an RF opaque material.

5. The RF applicator of claim 4, in which the walls are formed from aluminum.

6. The RF applicator of claim 1, in which the antenna body is formed from aluminum.

7. The RF applicator of claim 1, further comprising:

an antenna enclosure formed proximate the antenna body to protect the groups of slots from an environment external to the RF applicator.

8. The RF applicator of claim 7, in which the environment external to the RF applicator is a geologic formation containing oil shale, tar sand, or ground water contamination.

9. The RF applicator of claim 7, in which the antenna enclosure is formed from a material having a low dielectric constant.

10. The RF applicator of claim 9, in which the antenna enclosure is formed from a material having a similar dielectric constant relative to a material forming the RF transparent window arrangement.

11. The RF applicator of claim 9, in which the antenna enclosure is formed from fiberglass.

12. The RF applicator of claim 1, in which the antenna body comprises first and second ends; and a waveguide is coupled to the first end of the antenna body.

13. The RF applicator of claim 12, further comprising a cap coupled to the second end of the antenna body, with the cap substantially closing the second end of the antenna body.

14. The RF applicator of claim 13, in which the cap is arranged to reflect an RF signal propagated within the antenna body to generate constructive interference.

15. The RF applicator of claim 13, in which the cap is formed from RF reflective material.

16. The RF applicator of claim 1, in which each group of slots is arranged so as to radiate RF energy outwardly from the RF applicator measured in a plane perpendicular to the longitudinal axis.

17. The RF applicator of claim 1, in which at least some of the slots have slot widths that increase with increasing distance from the RF generator.

18. The RF applicator of claim 1, further comprising a tube into which the RF applicator is inserted.

19. The RF applicator of claim 16, wherein the outward radiation of at least one group of slots is approximately 135 degrees.

20. The RF applicator of claim 16, wherein the combined outward radiation of the groups of slots is approximately 270 degrees.

21. The RF applicator of claim 1, wherein the outer surfaces defining the groups of slots are substantially parallel to each other.

22. The RF applicator of claim 1, wherein the outer surfaces are substantially planar.

23. The RF applicator of claim 12, in which a transition module is interposed between the antenna body and the waveguide.

24. The RF applicator of claim 23, wherein the transition module has a longitudinal axis that is aligned with the longitudinal axis of the antenna body.

25. The RF applicator of claim 12, wherein a waveguide flange is interposed between the waveguide and the first end of the antenna body.

26. The RF applicator of claim 2, further comprising a RF transparent window arrangement disposed proximate each group of slots, so as to substantially seal the interior space of the antenna body from an environment external to the RF applicator.

27. The RF applicator of claim 26, in which the RF transparent window arrangement comprises a plurality of RF transparent windows formed from a material having a low dielectric constant.

28. The RF applicator of claim 26, in which the RF transparent windows are formed from a material selected from the group consisting of fiberglass and TEFLON® polytetrafluoroethylene.

29. The RF applicator of claim 1, in which the applicator has an operational frequency of approximately 915 MHz.

30. The RF applicator of claim 2, in which the interior space has a cross-sectional area of approximately 28 square inches.

* * * * *